United States Patent [19]

Schilling

[11] 4,388,957

[45] Jun. 21, 1983

[54] MULTIPLE BLADE SPLITTING DEVICE

[75] Inventor: Walter W. Schilling, Delta, Canada

[73] Assignee: MacMillan Bloedel Limited, Vancouver, Canada

[21] Appl. No.: 199,183

[22] Filed: Oct. 21, 1980

[51] Int. Cl.[3] ..... B27L 7/00

[52] U.S. Cl. ..... 144/366; 83/425.2; 144/175; 144/184; 144/193 R

[58] Field of Search ..... 144/2 R, 155, 175, 185, 144/190, 182, 184, 193 R, 193 A, 3 P, 366, 367, 369; 83/425.2, 446, 447

[56] References Cited

U.S. PATENT DOCUMENTS

| | | | |
|---|---|---|---|
| 195,651 | 9/1877 | Roelecke | 144/193 R |
| 651,663 | 6/1900 | Hindley et al. | 144/193 R |
| 1,503,784 | 8/1924 | Dumont | 144/184 |
| 2,323,760 | 7/1943 | Wolfinger, Sr. | 83/425.2 |
| 2,514,915 | 7/1950 | Von der Werth | 144/193 R |
| 3,407,855 | 10/1968 | Ritchie | 144/193 A |
| 3,802,473 | 4/1974 | Carr | 144/193 R |
| 3,872,903 | 3/1975 | Carr | 144/193 R |
| 3,998,252 | 12/1976 | Senba | 144/184 |
| 4,019,548 | 4/1977 | Lenderink et al. | 144/175 |
| 4,086,944 | 5/1978 | Traben | 144/3 P |

FOREIGN PATENT DOCUMENTS

| | | | |
|---|---|---|---|
| 729365 | 12/1966 | Italy | 144/193 R |

*Primary Examiner*—W. D. Bray

*Attorney, Agent, or Firm*—Schuyler, Banner, Birch, McKie & Beckett

[57] ABSTRACT

Methods and apparatus for splitting substantially straight grained lignocellulosic material substantially along grain lines into slabs are provided. The apparatus may comprise: means for advancing material along a direction of travel, a plurality of splitter blades, said blades being spaced along the direction of travel, and being laterally spaced apart in a stepped row from a first splitter blade located to commence splitting at one side of the material, to a last splitter blade located to finalize splitting at the opposite side of the material, and support means to support the material when advancing the material in the direction of travel and past said splitter blades, said apparatus permitting the split slabs to separate away from the remainder of said material. The apparatus may alternatively comprise an apparatus for splitting substantially straight grained lignocellulosic material substantially along grain lines into slabs comprising similar material advancing means and splitter blades, but wherein the support means to support the material is compressible, said apparatus permitting the material to move laterally away from the splitter blades and from the slabs being split therefrom in response to lateral forces created during splitting.

22 Claims, 10 Drawing Figures

MULTIPLE BLADE SPLITTING DEVICE

This invention relates to methods and apparatus for splitting substantially straight grained lignocellulosic material. More particularly, this invention relates to methods and apparatus for splitting wood sections or whole logs substantially along the wood grain into slabs.

Long wood strands with longitudinal grain extending along their lengths are required for the production of adhesively bonded structural lumber products. An example of one type of structural lumber product is disclosed in our U.S. Pat. No. 4,061,819 issued Dec. 6, 1977. One method of producing the long wood strands for a structural lumber product is disclosed in our copending U.S. application Ser. No. 885,985 (Canadian Ser. No. 298,831) filed Mar. 13, 1978 and now abandoned. In this specification, one embodiment of the invention describes the logs being first split substantially along the grain into sector shaped segments, further split into a plurality of slabs, and then finally split into wood strands with the grain generally extending along their length. Inasmuch as the logs are split along the grain line, the side faces of the slabs are not perfectly flat, but tend to be irregular. When wood is split into narrow strips or slabs, there is often a tendency for the strips to curl which damages the strips or slabs and in some cases they may even break. Thus, the present invention provides methods and apparatus for splitting a wood section such as a sector shaped segment substantially along the wood grain into slabs, and which do not cause excessive curling of the slabs as they leave the apparatus.

Although reference is made throughout the specification to splitting wood sections, whole logs could also be split into slabs on an apparatus of the present invention. Furthermore, any substantially straight grained lignocellulosic material may be split into slabs on the present apparatus.

When wood is pressure split, as opposed to being impact split, the cutting edge of a tapered metal blade is pressed into the wood until the wood on each side of the blade parts and a crack or split commences along the grain. Once the wood has commenced splitting, the cutting edge of the blade need not touch the wood, as the crack or split extends in front of the blade and tends to follow the grain in the wood. If the grain is twisted, then the split tends to follow the twist.

In one embodiment, the present invention provides an apparatus for splitting substantially straight grained lignocellulosic material substantially along grain lines into slabs, comprising: means for advancing such material along a direction of travel, a plurality of splitter blades, said blades being spaced along the direction of travel, and being laterally spaced apart in a stepped row from a first splitter blade located to commence splitting at one side of the material, to a last splitter blade located to finalize splitting at the opposite side of the material, and support means to support the material when advancing the material in the direction of travel and past said splitter blades, said apparatus permitting the split slabs to separate away from the remainder of said material.

In another embodiment, the present invention provides an apparatus for splitting substantially straight grained lignocellulosic material substantially along grain lines into slabs, comprising similar material advancing means and splitter blades, but wherein the support means to support the material is compressible, said apparatus permitting the material to move laterally away from the splitter blades and from the slabs being split therefrom in response to lateral forces created during splitting.

An additional embodiment of the invention comprises the combination of the features of the two above embodiments.

In a further embodiment, a method is provided for splitting substantially straight grained lignocellulosic material substantially along grain lines into slabs, comprising: advancing such material along a direction of travel past a plurality of splitter blades, said blades being spaced along the direction of travel, and being laterally spaced apart in a stepped row from a first splitter blade located to commence splitting at one side of the material, to a last splitter blade located to finalize splitting at the opposite side of the material, and permitting the split slabs to separate away from the remainder of said material.

In a still further embodiment, a method is provided for splitting substantially straight grained lignocellulosic material substantially along grain lines into slabs, comprising similarly advancing such material along a direction of travel past a similar plurality of splitter blades while permitting the material to move laterally away from the splitter blades and from the slabs being split therefrom in response to lateral forces created during splitting.

Another embodiment of the invention comprises the combination of the features of the two above-detailed methods.

In drawings which illustrate embodiments of the invention,

Figure 1:
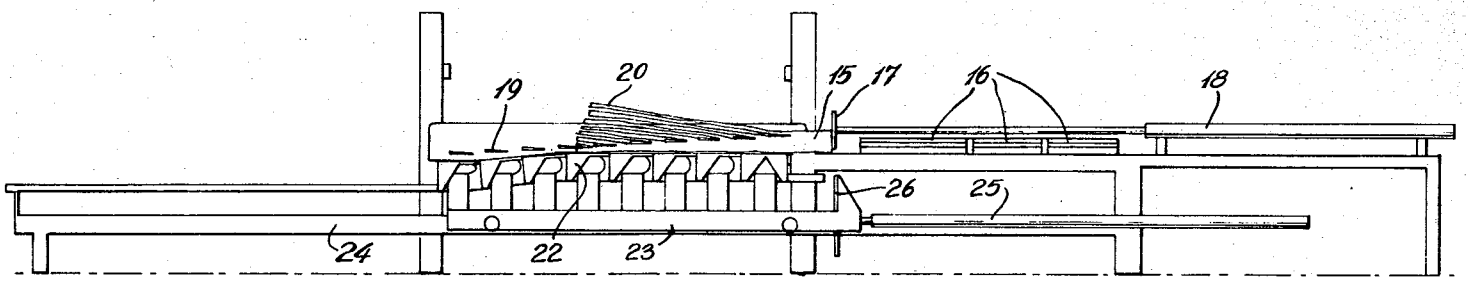
FIG. 1 is a side elevational view of one embodiment of an apparatus according to the present invention, with a wood section passing through the splitter blades.
Figure 2:
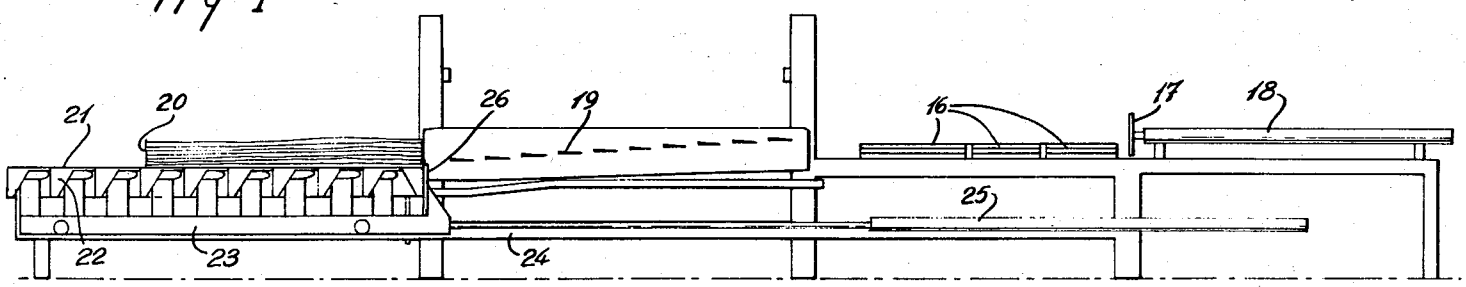
FIG. 2 is a side elevation of the apparatus shown in FIG. 1 with the wood section split into slabs.

One embodiment of an apparatus for splitting substantially straight grained lignocellulosic material into slabs is shown in FIGS. 1 and 2, wherein a wood section 15 is pushed from a first stationary support 16 by a ram 17 operated from a hydraulic cylinder 18 through a stepped row of splitter blades 19 to commence splitting the wood section 15 into slabs 20. The ram 17 pushes the wood section 15 from the first stationary support 16 onto a secondary support platform 21 which comprises a series of support plates 22 linked together. The second support platform 21 rests on a carriage 23 which in turn is moved along a track 24 by a second hydraulic cylinder 25. At the trailing edge of the carriage 23 is a vertical movable thrust member 26 which is raised to replace the ram 17 and complete the splitting of the wood section as the carriage 23 is moved along the track 24 so that the slabs 20 are split from the wood section 15.

Preferably, the apparatus is operated in a horizontal position so that the splitting proceeds in a substantially level fashion. However, the entire apparatus may be tipped at one end or toward one side. For example, the apparatus may be placed in a vertical position so that the force of gravity assists in the splitting. The only limitation on the orientation of the apparatus is that it should be operated to produce splits in wood in the desired fashion, along the grain thereof.

Hence, while the invention is discussed in the context of substantially horizontal operation, this is merely done for purposes of illustration and to avoid confusion.

Means may be placed below one end of a log being split so that the end is elevated with respect to the other end in the direction of travel during the splitting. This is particularly useful when splitting a log wherein the grain proceeds in general from one end of the log to the other, but where the grain centers of the log are at substantially different locations at the respective ends of the log.

Figure 3:
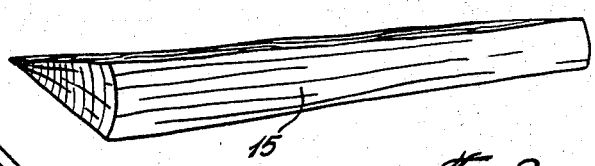
FIG. 3 is a perspective view of a sector shaped wood section.
Figure 4:
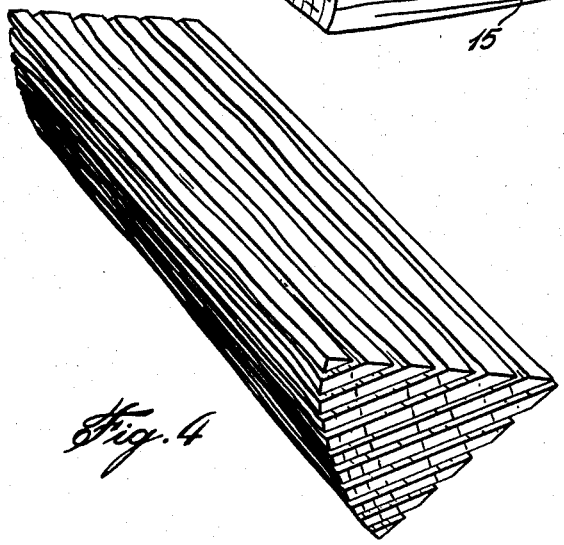
FIG. 4 is a perspective view of a sector shaped wood section split into substantially parallel slabs.

When wood is to be split into slabs, it is preferred to split directly across the annular growth rings of a tree. FIG. 3 shows a wood section 15 in the form of a sector shaped segment which has been radially split from a log. FIG. 4 shows the wood section 15 split into slabs 20. The splits are substantially parallel to each other and to the radius which bisects the sector shaped segment. Thus, the slabs 20 have substantially parallel sides. Furthermore, the splits occur across the growth rings of the tree.

Figure 5:
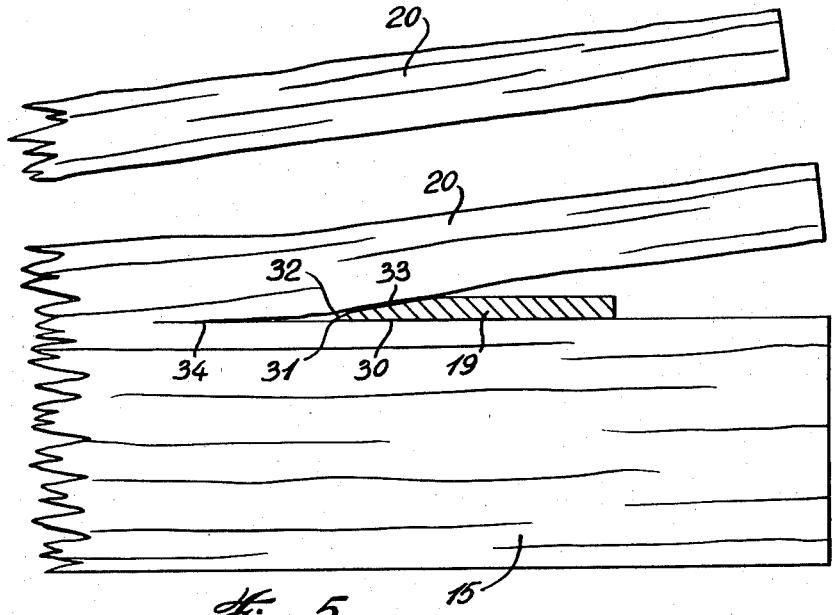
FIG. 5 is a detailed elevational view of a splitter blade splitting a slab from a wood section.
Figure 6:
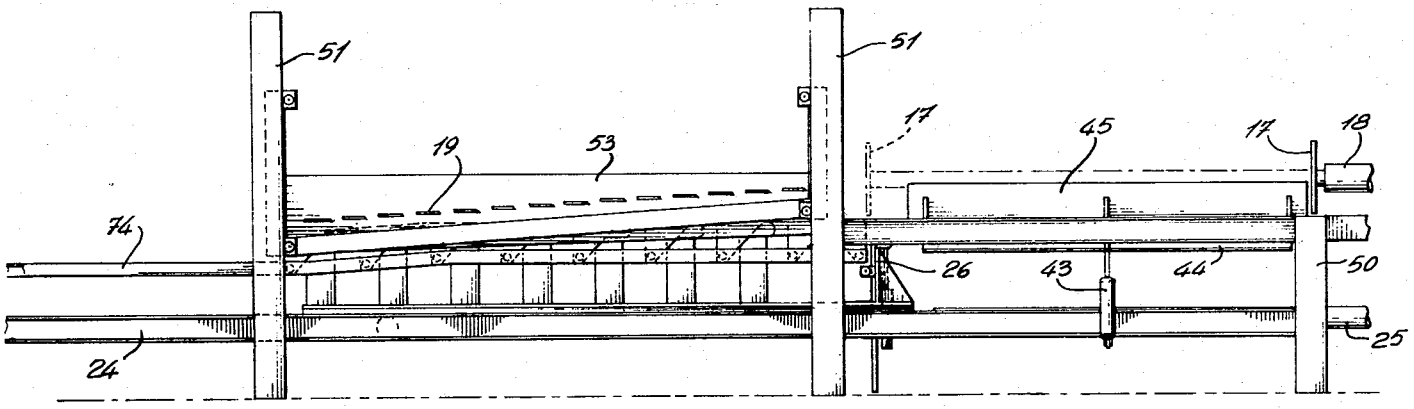
FIG. 6 is a partial side elevational view of the splitting device shown in FIG. 1.

An example of splitting is illustrated in FIG. 5 wherein a splitting blade 19 has a lower face 30 substantially parallel to the direction of travel of the wood section 15, a cutting edge 31 at the front of the splitting blade 19, and a first upper wedge face 32 extending upwards from the cutting edge 31 joining into a second upper wedge face 33 which is preferably at an angle of approximately 3° to the direction of travel, and acts to force the split slab 20 away from the remainder of the wood section 15 and extends the commencement of the split or crack 34 in advance of the cutting edge 31 of the blade 19. Although the first upper wedge face 32 is illustrated in FIG. 5, it will be apparent that this is not an essential part of the splitting blade 19, and the splitting blade 19 may be formed with merely one upper wedge face.

When wood is split in such a fashion that a slab 20 is removed from the remainder of a wood section 15, the slab 20 bends as it passes by the blade 19, which results in stresses near the splitting point. These stresses tend to cause the slab 20 to become progressively thinner. These stresses may also result in the occurence of internal cracks in the slab which may weaken the grain structure therein. This tendency during splitting may be minimized if the slab 20 is permitted to freely split away from the remainder of the wood section 15, rather than being constrained to bend around the blade 19 and rest under tension directly against the unsplit portion of the wood section 15. In one embodiment of the present invention, splitting is conducted such that no heavy pressure is applied by the apparatus to force or retain together the wood section with slabs during splitting. Light downward pressure may be applied to guide the slabs as they are removed from the wood section 15, but the primary pressure pushing down on the slabs being split comes merely from the weight of the slabs above them.

Some progressive reduction in the thickness of slabs produced often occurs. The remaining unsplit portion or "block" of the wood section 15 yet to be split by the blades correspondingly becomes progressively more acutely wedge-shaped. The variation in thickness of such a block of material from one end to the other, which block must be forced through the chamber of the splitter, may result in stresses within the splitter. These stresses may become sufficiently great to cause breakdown of the splitting operation, as by jamming of the wood section or by bending or breakage of blades. These problems are avoided by an embodiment of the present invention, wherein the support means for the wood section as it is moved past the blades is compressible. By this provision, the unsplit portion of the wood section being split may move away from the splitter blades and from the slabs being split therefrom, when pressure in the splitter becomes excessive. For example, if the apparatus of FIGS. 1 and 2 is operated so that the carriage 23 moves horizontally from right to left, the unsplit portion of the wood section 15 being split may move downward as necessary to relieve stress.

The two above embodiments of the invention may be employed either alone or together as needed. The decision to utilize one or both may readily be made by one skilled in the art.

Figure 7:
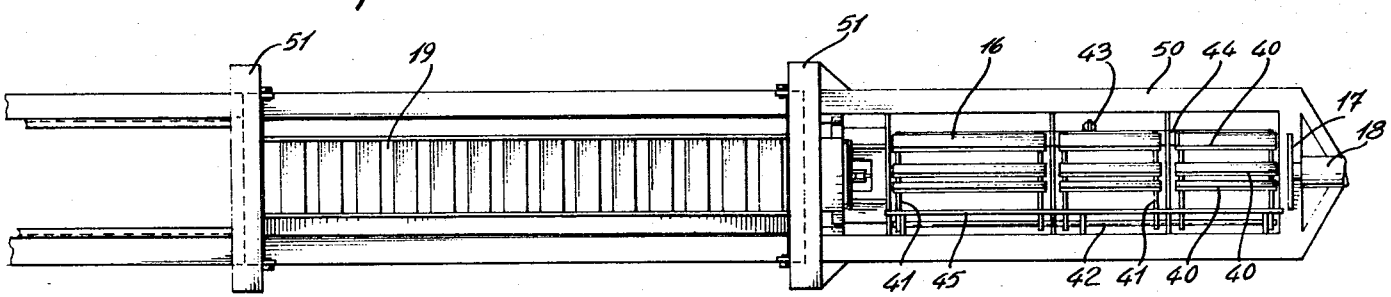
FIG. 7 is a partial plan view of the splitting device shown in FIG. 1.
Figure 8:
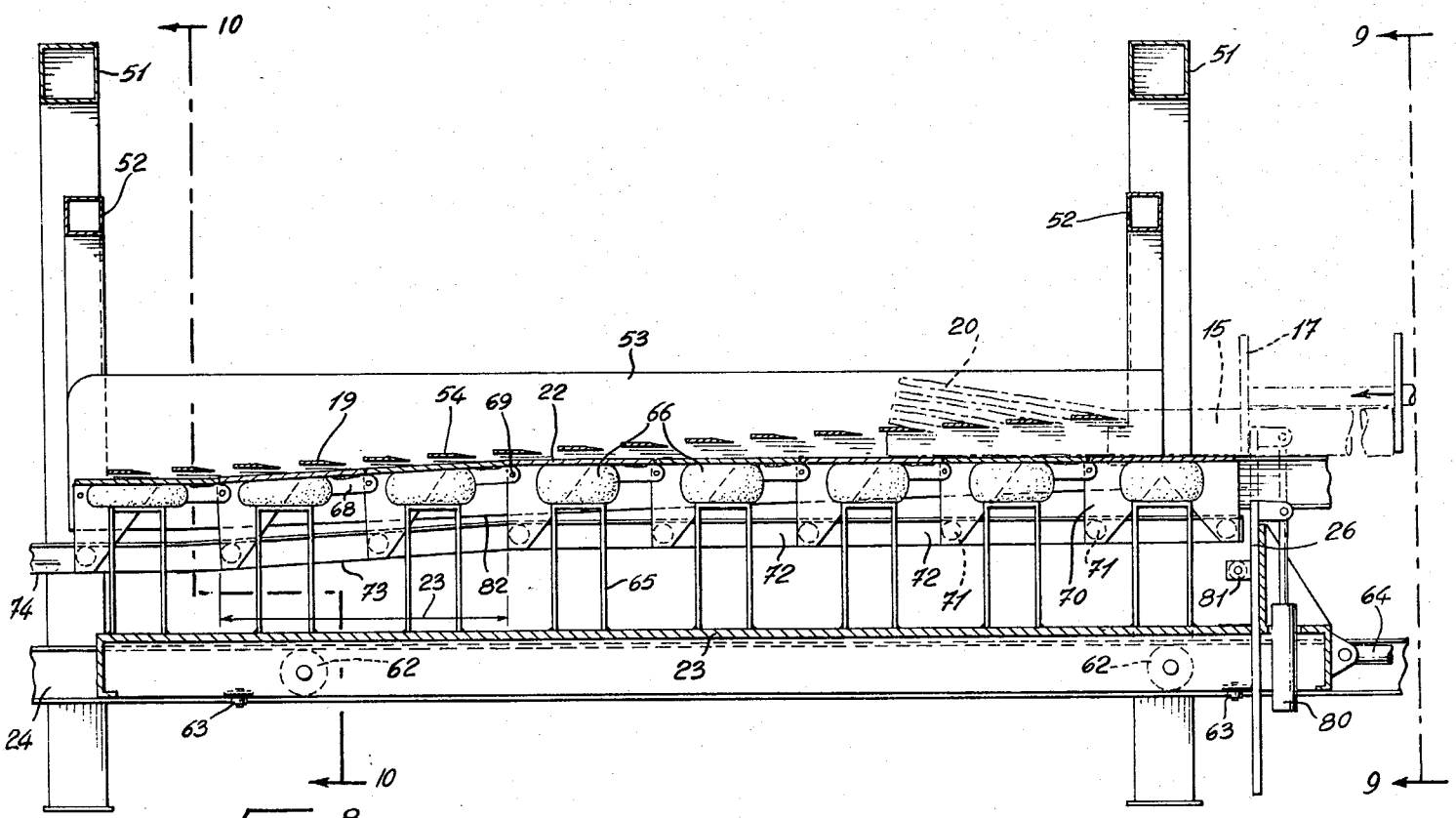
FIG. 8 is a partial sectional elevational view of the carriage of the splitting device shown in FIG. 1.
Figure 10:
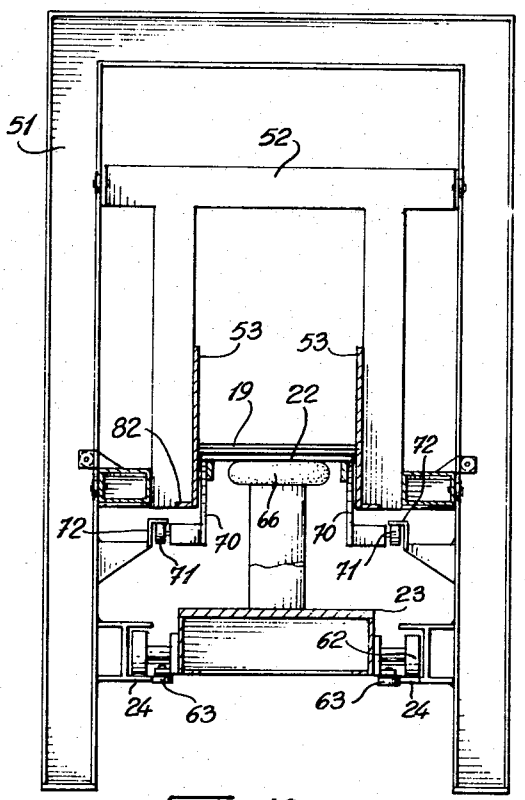
FIG. 10 is a sectional view taken at line 10—10 of FIG. 8.
Figure 9:
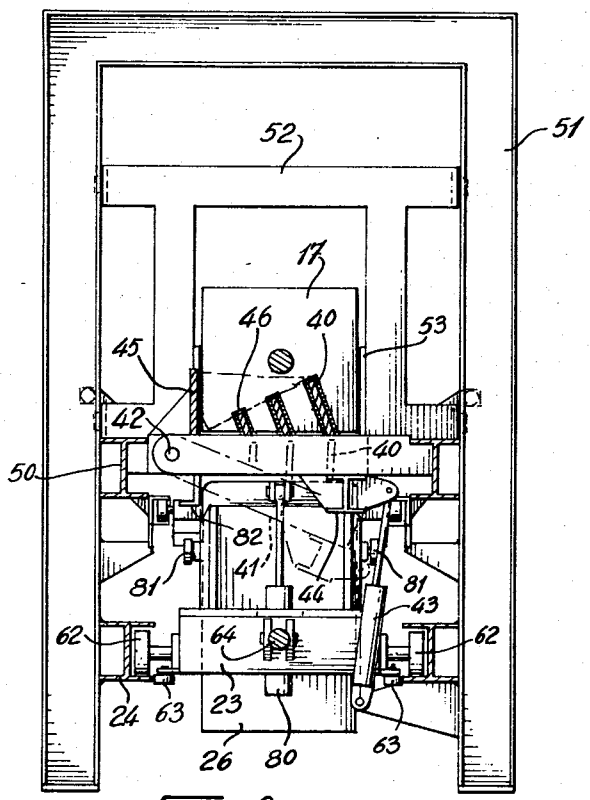
FIG. 9 is a sectional view taken at line 9—9 of FIG. 8.

Details of one specific embodiment of the splitting device are illustrated in FIGS. 6–10. The first stationary support 16 is in three sections as illustrated in FIG. 7. Each section has three plates 40 which are vertical when the support 16 is in a horizontal plane as illustrated by chain-dotted lines in FIG. 9. The plates 40 in each section are attached to support arms 41 which in turn are pivoted about shaft 42 as illustrated in FIG. 9. A single hydraulic cylinder 43 is vertically positioned beneath a horizontal bar 44 which raises the support arms 41 so they pivot about shaft 42 and thus vary the angle of the support plane from the horizontal plane. Thus, any shape of segment may be positioned on the three support plates 40, the hydraulic cylinder 43 is then activated to raise the support arms 41 so that the angle of the support plane changes and the wood segment 15 is positioned such that when it is split into slabs the splits occur as close as possible to being substantially perpendicular to the grain line. If one side face of a segment 15 was allowed to remain resting on a horizontal plane, then splitting would not occur perpendicular to the annular growth rings, which would result in poor quality strands. A side plate 45 as seen in FIG. 9 is provided to hold the wood section 15 on the first stationary support 16 and prevent sideways movement when the wood section is being forced through the splitter blades. As is also illustrated in FIG. 9 the ram plate 17 which is an extension of the first hydraulic cylinder 18 for pushing the wood section 15 through the splitter blades has cutouts 46 to allow the support plates 40 to be pivoted to any angle of the support plane.

The first hydraulic cylinder 18 is mounted on a main frame 50 which extends beyond the first stationary support in the direction of travel to provide structure for supporting the splitter blades 19 and supporting the split slabs. The frame 50 has two rigid cross frames 51, one at each end of the row of splitter blades 19, which support an interior frame 52 having two side plates 53 which have a series of slots 54 to hold the splitter blades 19. The slots 54 are located in a stepped row as illustrated in FIG. 8. The two side plates 53 have the slots 54 directly opposite each other so that each blade 19 may be slid through a pair of slots and supported at each end. Each blade has a locator in the form of a peg (not shown) which holds it in place so that it cannot slide out of the pair of slots during the splitting step. The blades may be changed by merely sliding them out of the slots 54 and inserting new blades. Thus, if blades become bent or need sharpening, they can easily be replaced.

A carriage track 24 is located beneath the interior frame 52 which supports a carriage 23. The carriage track 24 extends downstream to the end of the frame 50. The carriage 23 has support rollers 62 and side rollers 63 which run in the track 24. A second hydraulic cylinder 25 has a ram 64 to move the carriage 23 back and forth along the track 24. The frame of the carriage 23 has a plurality of structural stands 65 on which are mounted pneumatic air bags 66. On top of each air bag is a support plate 22, each support plate 22 having a link arm 68 and a pivot pin 69 so that the adjacent support plates are joined together in a long line to form a single movable support platform 21. Vertical arms 70 extend down from each side of the support plates 22 and have guide rollers 71 at their base, which are fitted below the horizontal flange of a guide track 72 supported on each side of the main frame 50. The guide tracks 72 prevent any upward movement of the guide rollers 71 and hence of the support plates 22. However, the guide tracks 72 do not prevent downward movement of the support plates 22, which is restricted only by air pressure within the pneumatic air bags 66. Thus some downward movement of the support plates 22 may occur due to downward pressure on the support plates 22 from the splitting action of the wood section 15 passing through the splitting blades 19. The guide tracks 72 commence by being horizontal and then have a downward sloping section 73 extending into a further horizontal section 74. Thus when the carriage 23 moves on the carriage track 24 the support plates 22 are initially free to move in a horizontal plane; subsequently they are depressed so that the air bags 66 are compressed as the guide rollers 71 traverse the downwards sloping section 73 of the track 72. As illustrated in FIG. 8 the support plates 22 are depressed downwards to miss the splitting blades 19, specifically the last five splitting blades in the row of splitting blades 19.

At the trailing edge of the carriage 23 is located a thrust member 26 for advancing the wood section 15 from the row of splitter blades 19. The thrust plate 26 moves vertically upwards and downwards in guides by means of a hydraulic cylinder 80. Guide rollers 81 are provided on each side of the thrust plate 26, which engage on the lower edges 82 of the side plates 53. The lower edges 82 are sloped downwards in the direction of travel so that when the carriage 23 moves along the track 24, the guide rollers 81 engage on the edges 82 and the thrust plate 26 slowly moves downwards so that the top of the thrust plate 26 just clears each splitting blade 19. The movement of the carriage 23 is such that the thrust plate 26 moves beyond the last splitting blade 19 but the guide roller 81 does not leave the edge 82 of the side plates 53 and, therefore, when the carriage 23 returns to the starting position, the thrust plate 26 always clears the splitting blades 19.

In operation, a wood section 15 is placed on the stationary support 16. If the wood section 15 is a segment similar to that shown in FIG. 3 then the pivot arm 41 holding the individual support plates 40 is pivoted about the pivot position 42 until the wood section 15 is arranged so that splitting occurs substantially radially. By the term "radially" is meant splitting such that at least one split in the center of the segment is substantially radial, and that the others are all substantially parallel to the center split such as that shown in FIG. 4. When the section 15 has been positioned on the stationary support 16 the hydraulic cylinder 18 is operated and the ram 17 pushes the wood section 15 into the plurality of splitting blades 19. Before this pushing step commences the carriage 23 is located directly beneath the splitting blades 19 so that there is support for the wood section 15 as it is pushed through the blades 19 to control bending or movement downwards of the wood section 15 and to ensure that splitting occurs.

The splitting action of the blades 19 is illustrated in FIG. 5. The tapered portion 33 of each blade 19 forces the slab 20 upwards and the split generally follows the grain line. However, wood generally does not have straight grain lines and, therefore, splits do not always extend either straight or parallel to each other. Some play is taken up by the compressed air bags 66 to allow depression of the support plates 22. It is preferable to allow a split to follow the grain line, but if the line is at a steep angle then the splitting blade has to cut across grain lines.

When the ram 17 comes to the end of its stroke the wood section 15 is well into the splitting blades 19 and the ram 17 then returns to its original position. At this point the second thrust plate 26 is raised by the hydraulic cylinder 80 as can be seen in FIG. 8. The second thrust plate 26 is raised behind the location of forward approach of the ram 17. The hydraulic cylinder 25 is activated and slowly pushes the carriage 23 along the carriage track 24. As the carriage progresses, the guide rollers 81 from the thrust plate 26 engage with the underneath edges 82 of the two side plates 53 and as these edges are sloped downwards the thrust plate 26 slowly moves down as the carriage 23 progresses along the track 24. Thus the top of the thrust plate 26 clears each splitting blade 19 but still pushes the unsplit portion of the wood section 15. As the sloped edges 82 are substantially in line with the stepped row of blades 19 the top of the thrust plate 26 moves in a line substantially parallel to the stepped row of blades 19.

The last few splitting blades 19 are located below the initial position of the support plates 22. The compressed air bags 66 allow for downward movement of the support plates 22. The forces to cause this downward movement arise from the natural tendency for splitting to cause the split section to move away from the splitting blade 19. These forces may be enhanced if the split does not extend in a plane parallel to the support plates 22. Additionally, when the guide rollers 71 for each support plate 22 reach the sloped section 73 in the guide rail 72, each support plate 22 moves downwards compressing the air bag 66 so that the support plate 22 clears the last few splitting blades 19. FIG. 2 illustrates the carriage 23 at the end of its movement with the thrust plate 26 shown at a location below the last blade 19 in the stepped row of blades. The wood section 15 has been split into slabs 20 which are ready for further splitting into strands.

The stepped row of splitting blades 19 may be varied according to the thickness of slabs 20 required from a wood section 15. Furthermore, the configuration of the splitting blades 19 may also be varied. FIG. 5 illustrates one embodiment having two angles of tapered section. It will be apparent that one single angle of tapered section could also be used. Whereas hydraulic cylinders are defined herein, these cylinders may be pneumatic, and other mechanical types of advancing mechanisms such as chain drives may be used. Furthermore, the air bags illustrated in the drawings may be replaced by other compressible means such as springs. Various other changes may be made in the details of the splitting device without departing from the scope of the present invention which is limited only by the claims.

I claim:

1. An apparatus for splitting substantially straight grained lignocellulosic material substantially along grain lines into slabs, comprising:

means for advancing such material along a direction of travel;

a plurality of splitter blades, said blades being spaced along the direction of travel, and being laterally spaced apart in a stepped row from a first splitter blade located to commence splitting at one side of the material, to a last splitter blade located to finalize splitting at the opposite side of the material; and compressible support means to support the material when advancing the material in the direction of travel and past said splitter blades, said support means permitting the material to move laterally away from the splitter blades and from the slabs being split therefrom in response to lateral forces created during splitting.

2. An apparatus for splitting substantially straight grained lignocellulosic material substantially along grain lines into slabs, comprising:

means for advancing such material along a direction of travel;

a plurality of splitter blades, said blades being spaced along the direction of travel, and being laterally spaced apart in a stepped row from a first splitter blade located to commence splitting at one side of the material, to a last splitter blade located to finalize splitting at the opposite sides of the material; and support means to support the material when advancing the material in the direction of travel and past said splitter blades, said apparatus permitting the split slabs to separate away from the remainder of said material said support means being a compressible support means permitting the material to move laterally away from the splitter blades and from the slabs being split therefrom in response to lateral forces created during splitting.

3. The apparatus according to claim 1 or 2 wherein the direction of travel is substantially horizontal.

4. An apparatus for splitting substantially straight grained lignocellulosic material substantially along grain lines into slabs, comprising:

means for advancing such material along a direction of travel;

a plurality of splitter blades, said blades being spaced along the direction of travel, and being laterally spaced apart in a stepped row from a first splitter blade located to commence splitting at one side of the material, to a last splitter blade located to finalize splitting at the opposite side of the material; and support means to support the material when advancing the material in the direction of travel and past said splitter blades, said apparatus permitting the split slabs to separate away from the remainder of said material said support means being a movable support means.

5. The apparatus according to claim 1 or 2 wherein the support means is a movable support means which has a trailing edge and the means for advancing the material includes a laterally movable thrust member on the trailing edge of the support means, the thrust member adapted to move in a path which passes laterally away from each of the plurality of splitter blades at approximately the same clearance as the movable support means advances in the direction of travel.

6. The apparatus according to claim 1 or 2 wherein the compressible support means comprises at least one air bag.

7. The apparatus according to claim 1 wherein the support means comprises a plurality of support plates pivotally joined together, each plate located on a compressible support unit, the plurality of plates and compressible support units mounted from a carriage which moves from the means for advancing material.

8. The apparatus according to claim 2 wherein the support means comprises a plurality of support plates pivotally joined together, each plate located on a compressible support unit, the plurality of plates and compressible support units mounted from a carriage which moves from the means for advancing material.

9. The apparatus according to claim 8 including a guide roller attached to each of the support plates and a fixed guide channel adjacent the splitter blades in the direction of travel having at least one sloping section therein, each guide roller running in the fixed guide channel adapted to laterally displace the support plates from a first position when the carriage moves in the direction of travel and the guide roller reaches the sloping section in the fixed guide channel, thus compressing the compressible support units under each of the support plates.

10. The apparatus according to claim 9 wherein the lateral displacement between the last splitter blade and the first splitter blade is greater than the lateral displacement between the support plates in the first position and the first splitter blade, and the sloping section occurs in the fixed guide channel adjacent the splitter blades such that the support plates are laterally displaced to pass by the splitter blades when the carriage advances in the direction of travel.

11. The apparatus according to claim 3 wherein the means for advancing material in a direction of travel includes a first means for advancing material into the plurality of splitter blades from a first stationary support means to a second movable support means, and a second means for advancing material together with the movable support means in the direction of travel.

12. The apparatus according to claim 1 wherein the means for advancing material in a direction of travel includes a first means for advancing material into the plurality of splitter blades from a first stationary support means to a second movable support means, and a second means for advancing material together with the movable support means in the direction of travel.

13. The apparatus according to claim 11 or 12 wherein the first and second means for advancing material in the direction of travel are hydraulic cylinders.

14. The apparatus according to claim 11 or 12 wherein the first stationary support means has adjustable support arms for providing a variable support plane for the material.

15. The apparatus according to claim 2 wherein the plurality of splitter blades are held between two fixed plates, each plate having a slot to locate each splitter blade, the plurality of splitter blades each being removable from the two plates.

16. The apparatus according to claim 2 wherein each of the plurality of splitter blades has a wedge face sloped upwards from the direction of travel.

17. The apparatus according to claim 16 wherein the wedge face of each of the plurality of splitter blades is sloped upwards from the direction of travel at an angle of approximately 3°.

18. The apparatus according to claim 2 wherein each of the plurality of splitter blades has an upper first wedge face sloped upwards from the direction of travel, followed by an upper second wedge face having a shallower angle than the first wedge face, and a lower face substantially parallel to the direction of travel.

19. The apparatus according to claim 18 wherein the upper second wedge face of each of the plurality of splitter blades is sloped upwards from the direction of travel at an angle of approximately 3°.

20. A method for splitting substantially straight grained lignocellulosic material substantially along grain lines into slabs, comprising: advancing such material along a direction of travel past a plurality of splitter blades, said blades being spaced along the direction of travel, and being laterally spaced apart in a single stepped row from a first splitter blade located to commence splitting at one side of the material, to a last splitter blade located to finalize splitting at the opposite side of the material, splitting successive slabs as said material moves past said blades, permitting the split slabs to separate away from the remainder of said material and moving the material laterally away from the splitter blades and from the slabs being split therefrom in response to lateral forces created during splitting.

21. The method according to claim 20 wherein the direction of travel is substantially horizontal.

22. The apparatus according to claim 1 or 2 wherein the support means is a movable support means.

* * * * *